US006514391B2

(12) United States Patent
Ko

(10) Patent No.: US 6,514,391 B2
(45) Date of Patent: Feb. 4, 2003

(54) ELECTROPLATING APPARATUS WITH CONDUCTING NETS FOR DISTRIBUTING EVENLY ANODE CURRENT

(76) Inventor: Jason Ko, No. 67-1, Tung-Yuan Rd., Chungli Industrial Park, Chungli City, Taoyuan Hsien (TW)

( * ) Notice: Subject to any disclaimer, the term of this patent is extended or adjusted under 35 U.S.C. 154(b) by 0 days.

(21) Appl. No.: 09/876,739

(22) Filed: Jun. 7, 2001

(65) Prior Publication Data

US 2002/0185371 A1 Dec. 12, 2002

(51) Int. Cl.[7] ..... C25D 17/00; C25C 7/00; C25B 9/00; C25F 7/00; B23H 11/00

(52) U.S. Cl. ..... 204/198; 204/206; 204/224 R; 204/275.1

(58) Field of Search ..... 204/198, 206

(56) References Cited

U.S. PATENT DOCUMENTS 4,755,271 A * 7/1988 Hosten ..... 204/198
4,986,888 A * 1/1991 Hosten et al. ..... 204/198
6,294,060 B1 * 9/2001 Webb et al. ..... 204/198

* cited by examiner

*Primary Examiner*—Nam Nguyen
*Assistant Examiner*—Erica Smith-Hicks
(74) *Attorney, Agent, or Firm*—Merchant & Gould P.C.

(57) ABSTRACT

An electroplating apparatus includes a plurality of feeding rollers adapted to advance a sheet-shaped article, and a spraying unit. The spraying unit has a pair of upper and lower casings, each of which includes a casing body defining a chamber, and a net plate disposed to confront with the article. An electrolyte is sprayed from the chamber via meshes in the net plate and onto a side surface of the article. An anode current-conducting assembly includes a conducting net that is disposed fixedly within the chamber and that is superimposed on the net plate so as to cover the meshes in the net plate, and two conducting units respectively in electrical contact with two opposite side portions of the conducting net so as to supply electric current to the conducting net.

3 Claims, 5 Drawing Sheets

ELECTROPLATING APPARATUS WITH CONDUCTING NETS FOR DISTRIBUTING EVENLY ANODE CURRENT

BACKGROUND OF THE INVENTION

1. Field of the Invention

This invention relates to an electroplating apparatus for electroplating a sheet-shaped article, more particularly to an electroplating apparatus, which includes an electrolyte-spraying casing that is provided with a conducting net for distributing evenly anode current.

2. Description of the Related Art

Referring to FIG. 1, a conventional electroplating apparatus 1 for electroplating a sheet-shaped article 10, such as a circuit board, is shown to include a feeding roller unit 11, a first spraying unit consisting of a pair of upper and lower anode nozzle units 13, 14, and an electrolyte-supplying pump unit 15. The article 10 is formed as a cathode, and is conveyed between the anode nozzle units 13, 14 by means of the roller unit 11. The anode nozzle units 13, 14 spray an electrolyte onto top and bottom surfaces of the article 10. When electric current flows through the electrolyte, metal ions in the electrolyte move toward, and are reduced and deposited on the article 10 to form a single layer of metal coating.

Referring to FIG. 2, a series of additional spraying units, each consisting of the anode nozzle units 13, 14, can be provided behind the first spraying unit in order to form several layers of metal coatings on the article 10 in sequence. The aforesaid conventional electroplating apparatus 1 suffers from the following drawbacks:

(1) Uneven distribution of the electrolyte on the article 10: Because the electrolyte is sprayed from the nozzle units 13, 14, it is concentrated on the areas of the article 10, to which the units 13, 14 are directed. In addition, it is difficult for the electrolyte to access the portions of the article 10 that are disposed adjacent to the feeding roller unit 11. Furthermore, the amount of the electrolyte deposited on the top surface of the article 10 is more than that on the bottom surface of the same.

(2) Uneven thickness of the metal coating on the article 10: Because the nozzle units 13, 14 cannot distribute an anode current evenly, it is impossible to obtain a uniform thickness of the metal coating on the article 10.

SUMMARY OF THE INVENTION

An object of this invention is to provide an electroplating apparatus with a spraying unit, which includes a pair of upper and lower casings that can maintain an even electrolyte distribution on top and bottom surfaces of a sheet-shaped article.

Another object of this invention is to provide an electroplating apparatus with an anode current-conducting assembly, which includes a conducting net and two conducting units and which maintains an even anode current distribution, thereby forming a uniform thickness of a metal coating on an sheet-shaped article.

According to this invention, an electroplating apparatus includes a plurality of feeding rollers adapted to advance a sheet-shaped article, and a spraying unit. The spraying unit has a pair of upper and lower casings, each of which includes a casing body defining a chamber, and a net plate disposed to confront with the article. An electrolyte is sprayed from the chamber via meshes in the net plate and onto a side surface of the article. An anode current-conducting assembly includes a conducting net that is disposed fixedly within the chamber and that is superimposed on the net plate so as to cover the meshes in the net plate, and two conducting units respectively in electrical contact with two opposite side portions of the conducting net so as to supply electric current to the conducting net.

Because the electrolyte is sprayed evenly from the meshes in the net plate, it can be distributed evenly onto the article. Furthermore, because anode current flows evenly into the electrolyte in the chambers via the conducting net, a metal coating with a uniform thickness can be formed on the article.

BRIEF DESCRIPTION OF THE DRAWINGS

These and other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
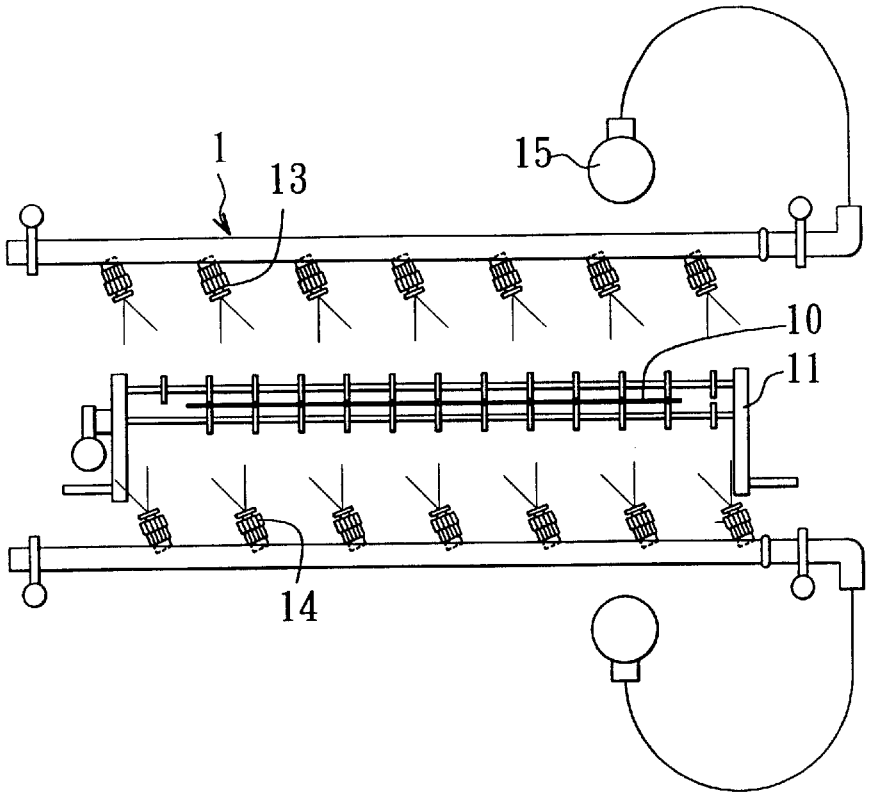
FIG. 1 PRIOR ART
FIG. 1 is a schematic front view of a conventional electroplating apparatus.
Figure 2:
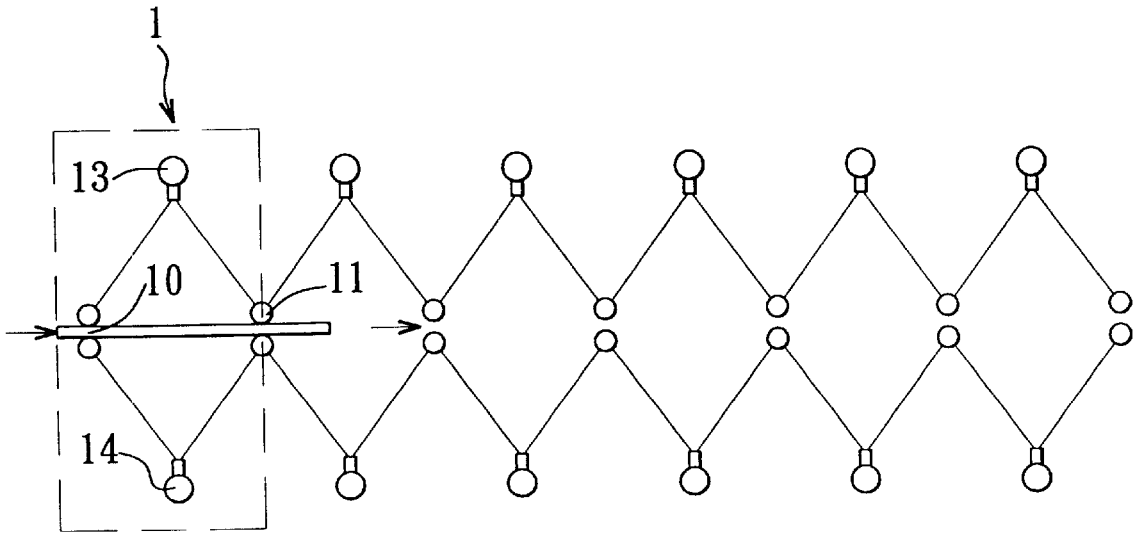
FIG. 2 PRIOR ART
FIG. 2 is a schematic side view of the conventional electroplating apparatus, in which several spraying units are shown.

Referring to FIGS. 3 through 8, the preferred embodiment of an electroplating apparatus 3 (see FIG. 3) according to this invention is shown to include a spraying unit consisting of a pair of rectangular upper and lower casings 4, 4' (see FIGS. 3 and 4) that are similar in construction, a plurality of cathode feeding rollers 5 (see FIG. 4), and a shielding roller set 6 (see FIG. 4) for preventing splashing-out of an electrolyte. The feeding rollers 5 move a sheet-shaped article 2 (see FIGS. 3 and 4), such as a printed circuit board, so as to advance the same along a path that is located between the upper and lower casings 4, 4' and that has an input end 41 (see FIG. 4) and an output end 42 (see FIG. 4).

It should be noted that although only one spraying unit is provided in this embodiment, a plurality of spraying units can be used in the electroplating apparatus in order to form a plurality of layers of metal coatings on the article 2.

Figure 5:
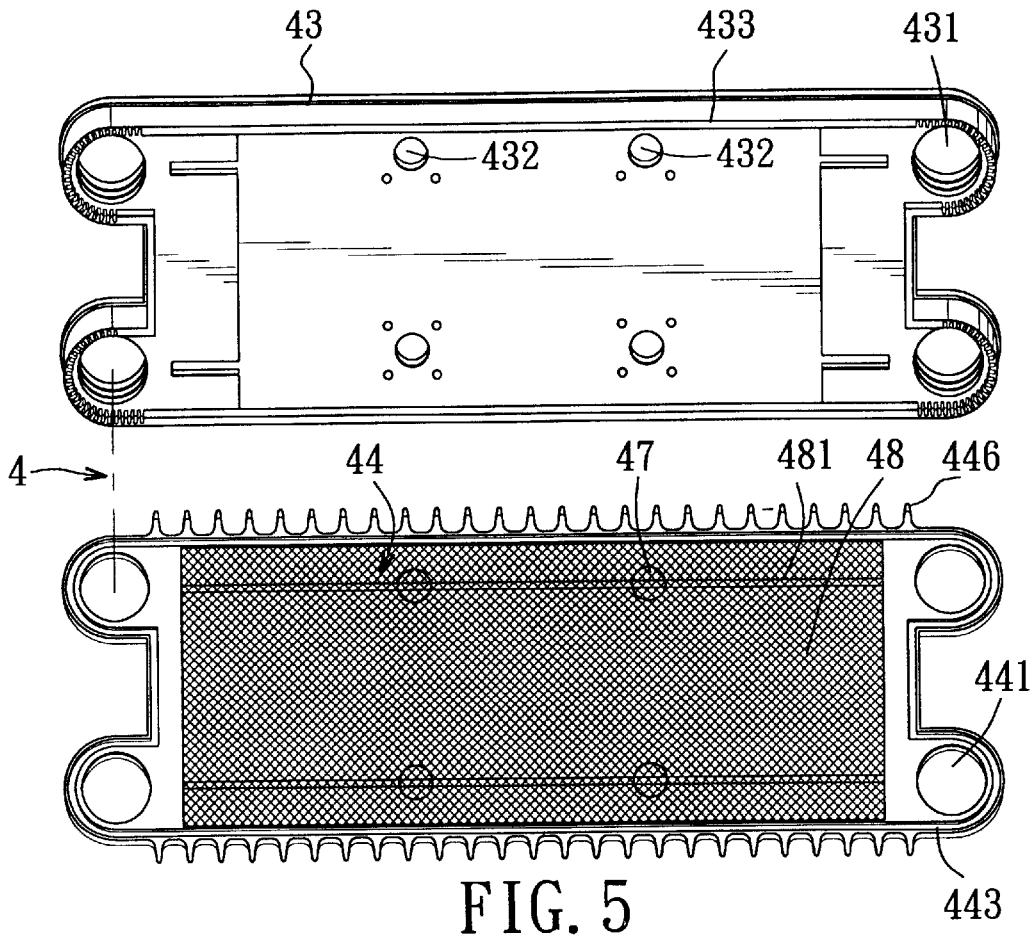
FIG. 5 is an exploded perspective view of an upper casing of the preferred embodiment, which is similar to a lower casing in construction.
Figure 6:
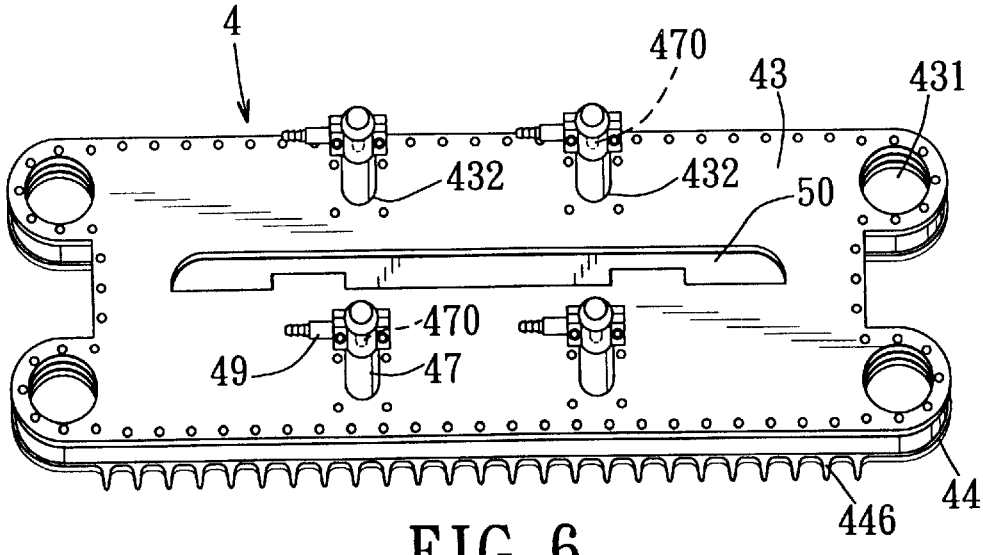
FIG. 6 is an assembled perspective view of the upper casing of the preferred embodiment.
Figure 7:
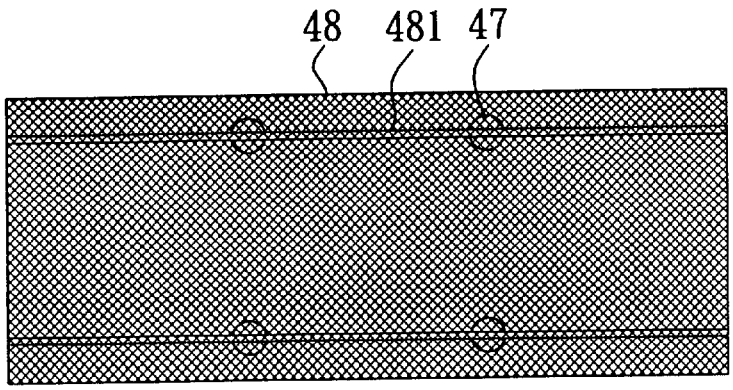
FIG. 7 is a schematic view, illustrating position relationships among a conducting net, two conducting ribs, and four conducting posts of the preferred embodiment.
Figure 8:
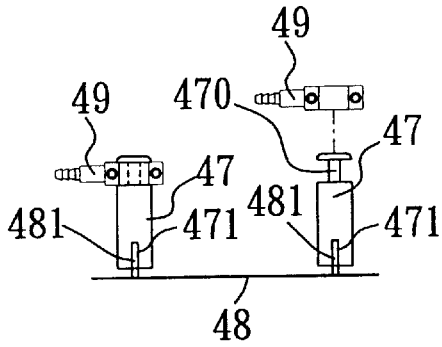
FIG. 8 is a schematic side view of the conducting net, the conducting ribs, and the conducting posts of the preferred embodiment.

Each of the upper and lower casings 4, 4' defines a chamber 40 (see FIG. 3) therein, and consists of a casing body 43 (see FIGS. 3, 5 and 6), and a net plate 44 (see FIGS. 3, 5 and 6), each of which has an inlet portion 431, 441 (see FIG. 5). The net plate 44 are attached removably to the casing bodies 43, e.g. by bolts. Each of the casing bodies 43 has an outer surface, which is provided with a fixed reinforcing plate 50 for facilitating holding of the latter. Each of the net plates 44 is formed with two rows of fixed guiding teeth 446 (see FIGS. 4 and 7) that are disposed respectively along two opposite sides thereof and that have inclined guiding surfaces 447 (see FIG. 4) for guiding the article 2 into the input end 41 of the path. The inlet portions 431, 441 are disposed respectively at four corners of the upper and lower casings 4, 4', and constitute an inlet unit, through which an electrolyte is fed into the chamber 40 in the casing body 43.

Figure 3:
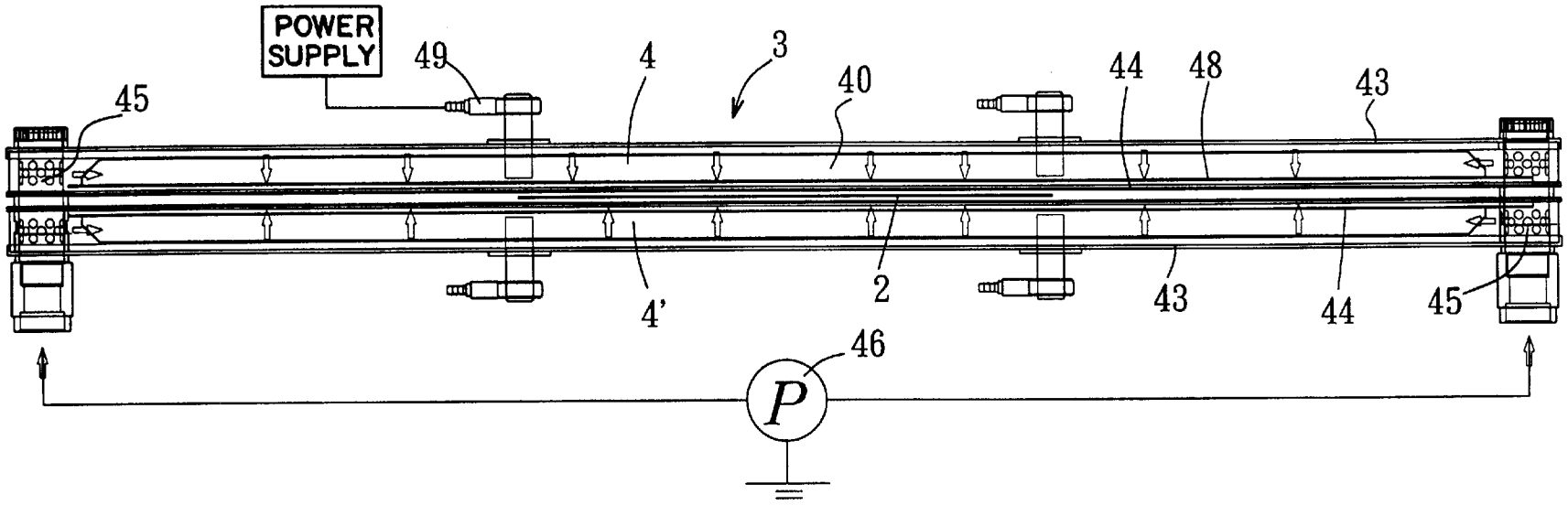
FIG. 3 is a schematic front view of a spraying unit of the preferred embodiment of an electroplating apparatus according to this invention.
Figure 4:
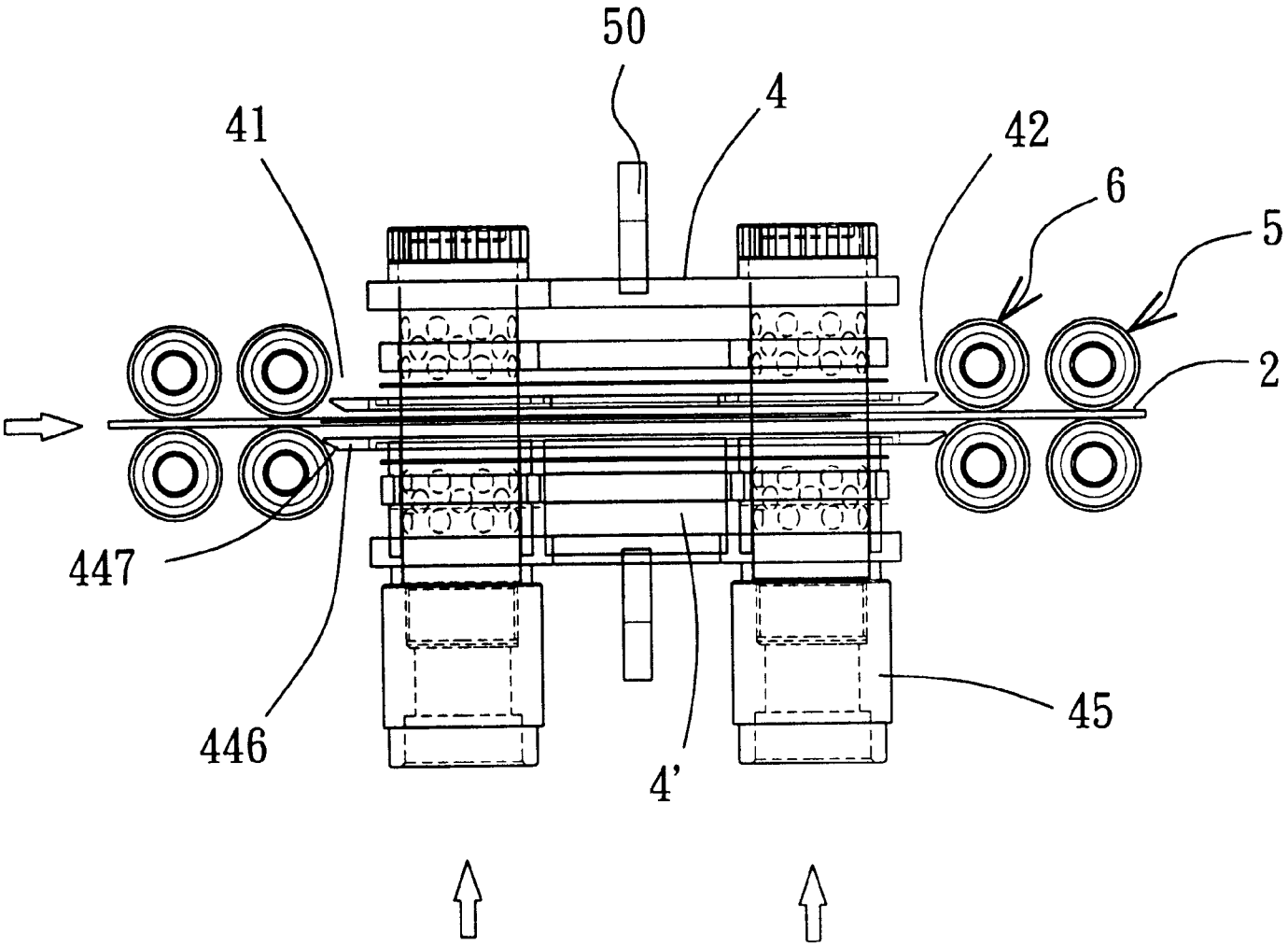
FIG. 4 is a schematic side view of the preferred embodiment.
Figure 9:
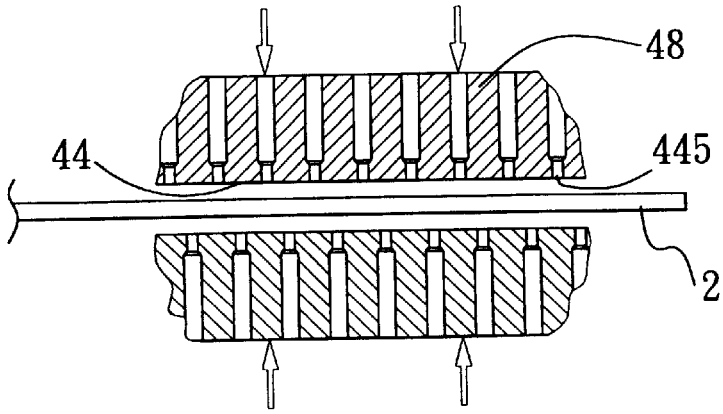
FIG. 9 is a schematic view illustrating two net plates of the preferred embodiment, each of which is formed with a plurality of meshes.

The upper and lower casings 4, 4' are coupled to a plurality of water conduits 45 (see FIGS. 3 and 4), via which an electrolyte is forced into the inlet portions 431, 441 by means of a pump 46 (see FIG. 3). In each of the upper and lower casings 4, 4', four conducting posts 47 are fixed to a conducting net 48 (see FIGS. 3, 5, 7 and 8), which is disposed within the chamber 40 and which is superimposed on the net plate 44 so as to cover a plurality of meshes 445 (see FIG. 9) in the net plate 44, which are in fluid communication with the chamber 40. In this embodiment, the conducting net 48 is made of titanium, and has two opposite side portions, which are provided respectively with two fixed conducting ribs 481 (see FIGS. 5, 7 and 8) that are in electrical connection therewith and that are press fitted respectively within two slots 471 (see FIG. 8) in end surfaces of the conducting posts 47. Accordingly, each of the conducting posts 47 is in electrical connection with the corresponding conducting net 48. Each of the ribs 481 is in electrical connection with two of the posts 47, which constitute a conducting unit. In each of the upper and lower casings 4, 4', two conducting units are respectively in electrical connection with two opposite side portions of the conducting net 48, thereby resulting in an even distribution of an anode current on the same. Each of the conducting posts 47 extends through a hole 432 (see FIG. 5) in the casing body 43, and is formed with a mushroom-shaped contact end 470 (see FIG. 8), on which a terminal element 49 (see FIGS. 3 and 9) is sleeved fixedly. Each of the casing bodies 43 is formed with a positioning plate unit 433 that engages fittingly a positioning slot unit 443 in the corresponding net plate 44, thereby positioning the casing bodies 43 relative to the net plates 44. The conducting posts 47 and the conducting net 48 constitute an anode current-conducting assembly. Because the article 2 is in electrical contact with the cathode feeding rollers 5, it is formed as a cathode. When a power supply, shown in FIG. 3, offers electric current to the conducting posts 47 via the terminal elements 49, the electric current flows evenly into the electrolyte in the chamber 40 via the conducting net 48 so as to ionize the metal atoms in the electrolyte. As such, the electrolyte is sprayed evenly from the meshes 445 in the net plate 44 according to the Bernoulli's theorem so that it can be distributed rapidly and evenly onto the article 2. That is to say, the flow quantity of electrolyte unit time per mesh is constant. Furthermore, because anode current flows evenly into the electrolyte in the chambers 40 via the conducting net 48, a metal coating with a uniform thickness can be formed on the article 2.

With this invention thus explained, it is apparent that numerous modifications and variations can be made without departing the scope and spirit of this invention. It is therefore intended that this invention be limited only as indicated by the appended claims.

I claim:

1. An apparatus for electroplating a sheet-shaped article, said apparatus comprising:

a plurality of feeding rollers adapted to advance the article along a path; and a spraying unit disposed on the path and including an upper casing and a lower casing that is disposed under said upper casing, said upper and lower casings being located on two sides of the path, each of said upper and lower casings including a casing body defining a chamber that is adapted to contain an electrolyte therein, an inlet unit, via which the electrolyte is fed into said chamber, a net plate attached removably to said casing body and disposed to confront with the article, said net plate having a plurality of meshes in fluid communication with said chamber, the electrolyte being sprayed from said chamber via said meshes in said net plate and onto a side surface of the article, an anode conducting net disposed fixedly within said chamber and superimposed on said net plate so as to cover said meshes in said net plate, and two conducting units respectively in electrical contact with two opposite side portions of said conducting net so as to supply electric current to said conducting net.

2. The apparatus as claimed in claim 1, wherein said conducting net is rectangular, each of said conducting units including two conducting posts, each of which has an end surface that is formed with a slot, said posts being adapted to be connected electrically to a power supply, said side portions of said conducting net of each of said upper and lower casings being provided respectively with two fixed parallel conducting ribs that are press fitted respectively within said slots in said posts of a respective one of said conducting units so as to establish electrical connection between said conducting net and said posts of the respective one of said conducting units.

3. The apparatus as claimed in claim 1, wherein each of said upper and lower casings is rectangular, and has four corners, said inlet unit of each of said upper and lower casings including four inlets that are formed respectively in said corners.

* * * * *